United States Patent [19]

Stieff et al.

[11] 4,262,284

[45] Apr. 14, 1981

[54] SELF-MONITORING SEAL

[76] Inventors: Lorin R. Stieff; Charles B. Stieff, both of P.O. Box 263, Kensington, Md. 20795

[21] Appl. No.: 918,866

[22] Filed: Jun. 26, 1978

[51] Int. Cl.[3] ..... G08B 13/06

[52] U.S. Cl. ..... 340/568; 340/507; 340/542; 340/691

[58] Field of Search ..... 340/542, 568, 380, 691, 340/534, 533, 507

[56] References Cited

U.S. PATENT DOCUMENTS

| | | | |
|---|---|---|---|
| 3,588,811 | 6/1971 | Prickett | 340/380 |
| 3,710,372 | 1/1973 | Andersson et al. | 340/568 |
| 3,735,353 | 5/1973 | Donovan et al. | 340/534 |
| 3,993,987 | 11/1976 | Stevens | 340/542 |
| 4,000,416 | 12/1976 | Goell | 340/380 |

*Primary Examiner*—Glen R. Swann, III

*Attorney, Agent, or Firm*—James C. Wray

[57] ABSTRACT

Self-monitoring seals have ends of fiber optic bundle loops mounted in stressed tamper resistant containers. A battery operates microelectronics to change a display in predetermined sequence. Tampering with the container or interrupting or changing the light transmission through the fiber optic bundle disrupts the predetermined display sequence.

25 Claims, 6 Drawing Figures

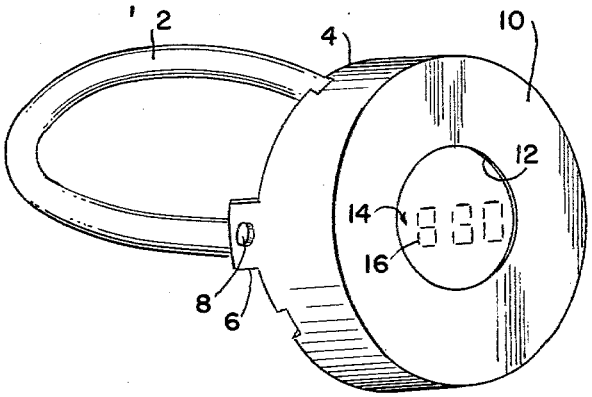
FIG. 1
FIG. 2
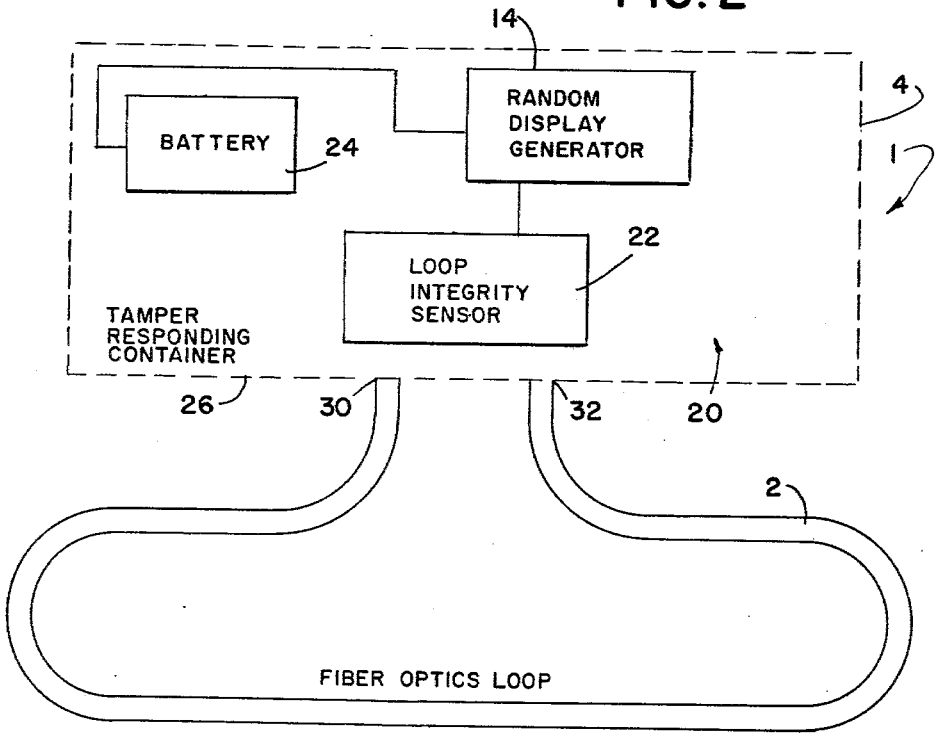

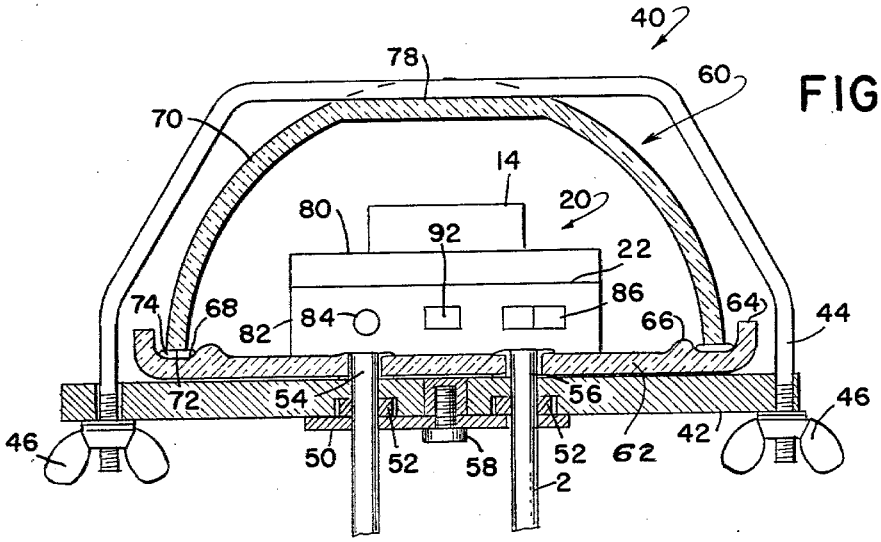
FIG. 3
FIG. 4
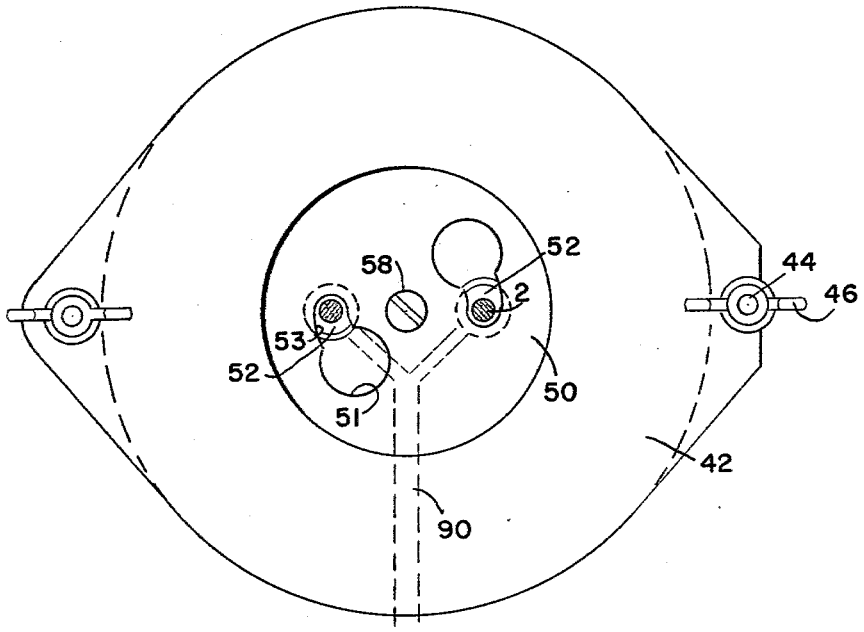

SELF-MONITORING SEAL

SUMMARY OF THE INVENTION

The self-monitoring seal is an electronic security seal. When installed, this seal readily reveals tampering with instrumentation or containers used at facilities where important materials are stored.

The seal is the size of a padlock and opens and closes like a padlock. It employs a multi-strand fiber optic loop as its shackle; both ends connect to an electronics package which includes a loop integrity sensor, unique identification sequence generator, tamper-responding container, batteries, display and external interface for remote monitoring.

When a seal is in use, the loop integrity sensor transmits light pulses into one end of the fiber optic loop. If the pulses reentering the electronics package from the other end of the loop do not correspond to the pulses transmitted, the display generator indicates a violation by changing identification sequences produced after that time.

Each seal is programmed to generate unique sequences of different numbers and letters. It is these sequences that provide the identity of the seal. For each seal, these sequences change at preset intervals, once every 1, 2, 4, 8, 16 or chosen number of hours. Unlike other seals that provide their complete identity at all points in time, the information that identifies the self-monitored seal is distributed through time.

The sequence for each seal are electronically generated in a verifier maintained by the authority that installs the seal. During routine checks of the seal, a representative of that authority sees at a glance if the seal display corresponds with the verifier. The sequence of displays also can be reported to the authority automatically. By studying a complete record of past displays, the sealing authority can determine if and when (to within a change interval) a violation of the seal has occurred.

Each seal can be reused by reprogramming the sequence display generator with one of a large number of unique sequences and by installing fresh batteries. The batteries contained within the seal are sufficient to operate the seal for a year.

The self-monitoring seal is a security seal that continuously monitors the integrity of the sealing device and displays the status, unviolated or violated, in a simple manner. The status of the seal can be reported automatically or identified by observing the seal's optical display. The observation can be made by a representative of the authority that installed the seal or by a representative of the facility operator in which the seal is installed (with the observation reported to the authority).

The self-monitoring seals display alphanumeric characters that change with time. The correct display sequences are known only to the verification authority that installs the seal. The time interval between seal display changes determines the time resolution within which the authority can determine if a seal has been violated.

The seal is completely self-powered and self-contained. No action is required of the host facility operator except possibly the reading of the display. The batteries within the seal provide operation up to a year or longer.

Removal of the seal immediately terminates the generation of the display sequence. Only the installing authority can restart the generation of display sequences. The installing authority can also reprogram the seal to generate other unique display sequences and the seal thus becomes reusable.

As a security seal, the self-monitoring seal provides several unique capabilities:

1. High Security,
2. Field Verification while Installed,
3. Remote Verification,
4. Time Resolution of Integrity, and
5. Reusability.

This seal is intended for use in applications that require one or preferably more of these features. The sealing of containers for large quantities of strategically or economically valuable materials is one potential application. Unattended instrumentation used to monitor such material may also require the use of a seal with these features to assure the validity of the data collected.

The normal operational cycle for the self-monitoring seal is as follows: (1) The random display generator is programmed by a special digital computer and started by the verification authority just prior to the modules deployment to the host's facility; (2) Personnel of the verification authority attach the module to the fiber optic seal and record the installed seal location and the displays before and after installation; (3) The host may read and record the display at intervals requested by the authority and report that information at times selected by the authority. During each visit by the verification authority's personnel to the host's facility, the seal's point of application and the seal's integrity (correct display value) is determined. During these visits, the electronic modules approaching the end of their operational phase, either due to battery life or number of display changes, are replaced with modules that have been reprogrammed and contain fresh batteries. The removed modules are returned to the verification authority's headquarters to be reprogrammed for future reuse.

The self-monitoring seal consists of two major parts: a fiber optic loop or seal and the electronic module that verifies the loop's integrity. The module uses integrated circuits to store programming information and control generation of display sequences. The integrated circuits and batteries are enclosed in a tamper-responding container.

Any attempt to gain access to the integrated circuit results in the interruption of electrical power to the circuit. Since the programming information is stored in a volatile form, loss of electrical energy causes loss of this information. Correct display sequences cannot be reported after this has occurred.

The monitor module is composed of four subsystems: the loop integrity sensor, the random display generator, the tamper-responding container and the batteries.

The loop integrity sensor uses an optical source and detector to determine the continuity of the fiber optic bundle while the module and loop are attached. Detection of loss of optical continuity by either detaching the module or violating the loop results in a loss or change of operation of the random display generator that identifies the seal.

The output of the random display generator comprises symbols. The character display is selected to minimize the amount of information to be stored and retrieved at the verification authority. The reporting of a correct display enables the verification authority to state with a high probability that the seal has not been violated. For the reporting of two or more correct displays in sequence, the probability of non-violation approaches 100 percent.

The pseudo-random sequence display generator, the loop integrity sensor, and the batteries that power them are enclosed within a tamper-responding container. The response of the container to any attempt to gain physical access to the three enclosed sub-systems is the interruption of the electrical circuit supplying energy from the batteries to the other two electronic sub-systems. Loss of the programming information in the random display generator results when the supply of energy is interrupted. After that point in time, the generator cannot produce the correct sequence of displays. Without the tamper-responding enclosure, an adversary could gain electrical access to the random display generator and determine the programming information and thereby predict the future sequence of displays. With this information, an adversary could delay the verification authority's knowledge that the seal was violated.

OBJECTS OF THE INVENTION

An object of the invention is the provision of a self-monitoring seal having a container, a communication fiber optic loop means extending from the container, and a monitor mounted in the container adjacent the communication loop.

Another object of the invention is the provision of a self-monitoring seal with a communication loop which is a fiber optic bundle.

Another object of the invention is the provision of a self-monitoring seal having an alphanumeric display with changeable characters.

Another object of the invention is the provision of a self-monitoring seal with an electronic monitor means connected to a display for sequentially changing the display in a predetermined manner.

Another object of the invention is the provision of a self-monitoring seal having an integrity sensor mounted in a tamper indicating container, a battery and a random display generator, which indicates compromise of the container or a sealing loop.

The invention has as a further object the provision of a self-monitoring seal with a light transmitting loop having first and second ends connected to a container and a loop integrity sensor having a light source and light detectors in the container, and a comparator.

Another object of the invention is the provision of a self-monitoring seal with a sequence generator connected to a display, a clock pulser connected to the sequence generator, a loop integrity sensor and keying means supplying signals to the sequence generator whereby the sequence generator stores and shifts values according to inputs and sequentially changes the display in a predetermined manner when a seal is intact.

Another object of the invention is the provision of a seal monitoring method by transmitting a signal through a communication loop which engages an object to be sealed, receiving a signal from the communication loop, comparing the signals transmitted and received, and effects a readout according to the comparison.

Another object of the invention is the provision of the method as described and further providing clocking whereby the readout is changed in a predetermined timed relationship.

Another object is the provision of the method as described with a clocking signal supplied to a microprocessor which creates a readout signal.

Another object of the invention is the provision of a self-monitoring seal with a readout, a clock, a sealing loop and container integrity sensors and a battery connected to a microprocessor for changing the readout in predetermined sequences while the loop and container are integral.

These and further objects and features of the invention are apparent in the disclosure which includes the above and on going specification with the claims and the drawings.

BRIEF DESCRIPTION OF THE DRAWINGS

FIG. 1 is a perspective view of an embodiment of the self-monitoring seal.

FIG. 2 is a schematic view of elements of the seal.

FIG. 3 is a cross-sectional schematic view of one embodiment of the seal of the present invention.

FIG. 4 is a view of the base of the embodiment shown in FIG. 3.

DETAILED DESCRIPTION OF THE DRAWINGS

Figure 5:
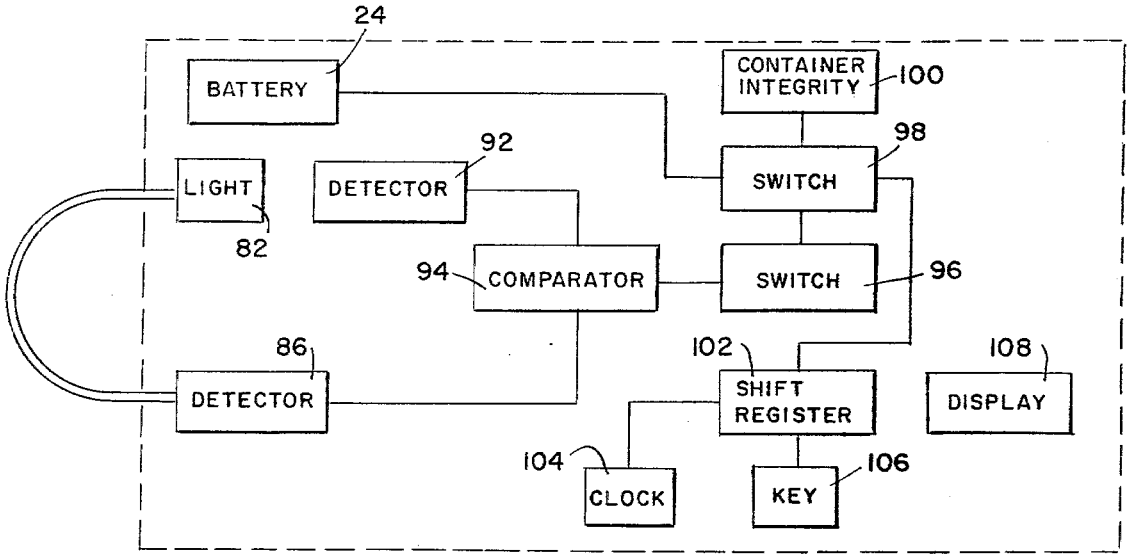
FIG. 5 is a schematic view of the parts of one embodiment of the seal and monitoring means.

FIG. 1 shows a self-monitoring seal 1 having a communications loop means 2 which is a fiber optic bundle. A container means 4 is constructed of a highly stressed tamper responding material, for example highly stressed glass. The fiber optic bundle is connected to base 6 of the container 4 by clamping means 8. The cover 10 of container 4 is made of stressed glass, for example, being substantially opaque. The opaque portion may be coated with a thin metal foil or a suitable electrical coating or the glass may be rendered opaque. A central area 12 of the stressed glass remains clear to reveal a display 14 which shows alphanumeric characters 16. The alpha numeric characters may be changed to form different symbols in a conventional well-known manner.

As shown in FIG. 2, the monitoring means generally indicated by the number 20 has a loop integrity sensor 22 and a battery 24 which supplies power to the random or psuedo random display generator 14 and the loop integrity sensor. A tamper resistant container 26 receives first and second ends 30 and 32 of fiber optic loop 2.

In one embodiment 40 of the invention as shown in FIG. 3, a base 42 has openings to receive legs of clamp 44. Wing nuts 46 secure the clamp to the base.

A fiber optic bundle clamp 50, as also shown in FIG. 4, holds ends of fiber optic bundle 2 tightly within the base 42. Collars 52 are fixed to the fiber optic bundle near opposite ends. As seen in FIG. 4, the clamp 50 has large openings 51 through which collars 52 may pass. When the ends of the fiber optic bundle are inserted in the container with the collars 52 positioned in recesses in base 42, the clamp is turned so that ends of the bundle extend through restricted openings 53 which prevent passage of collars 52. Remote ends 54 and 56 of fiber optic bundle 2 are held tightly in exact position within openings in the flat bottom of the stressed glass container. A screw 58 tightly secures clamp 50 in place.

The stressed glass container 60 has a base 62 with two openings for tightly receiving ends of the fiber optic bundle. An upturned edge 64 of the circular base 62 and an intermediate bead 66 form a peripheral trough 68 in which the lower end 72 of dome-like cover 70 is received. An O-ring 74 is compressed within the trough to seal the dome to the base.

A container integrity microswitch 100 shown in FIG. 5 detects loosening or removal of dome 70 from base 62.

The entire base and dome may be rendered opaque and may be electrically screened with the exception of a window at the upper flattened area 78 through which display 14 is read.

The monitoring means 20 includes the seal integrity sensor 22 and the display 14. Part of the integrity sensor and random display generator are the microelectronics 80, a light source 82 with a lamp 84 and detectors 86. The lamp provides a continuous or variable, regular or irregular pulsating light to the end 54 of fiber optic bundle 2. Detector 92 directly detects the light from the light source, and another detector 86 detects light from an end 56 of the fiber optic loop 2. A comparator in the microelectronics compares signals from the light detectors.

As shown in FIG. 5 the container 60 has a battery 24, light source 82, and detector 86. The detector 92 for the light source 82 and detector 86 supply signals to comparator 94 which controls a switch 96. A second switch 98 is controlled by switch 96 and by container integrity sensor 100.

When comparator 94 signals a diffence between detectors 92 and 96, switch 96 turns switch 98 to off. When container integrity sensor 100 senses tampering with the container, switch 98 is turned off, discontinuing the battery power supply to the shift register 102 and clock 104.

A key 106 provides initial setting of the shift register, and clock signals from clock 104 control the shifting so that display 14 is changed in a predetermined way by predetermined changes in shift register 102 until switch 98 interrupts power to the shift register.

Key 106 may be, for example, a photocell which receives light pulses through a window in the tamper resistant container to set the register in a predetermined manner.

Figure 6:
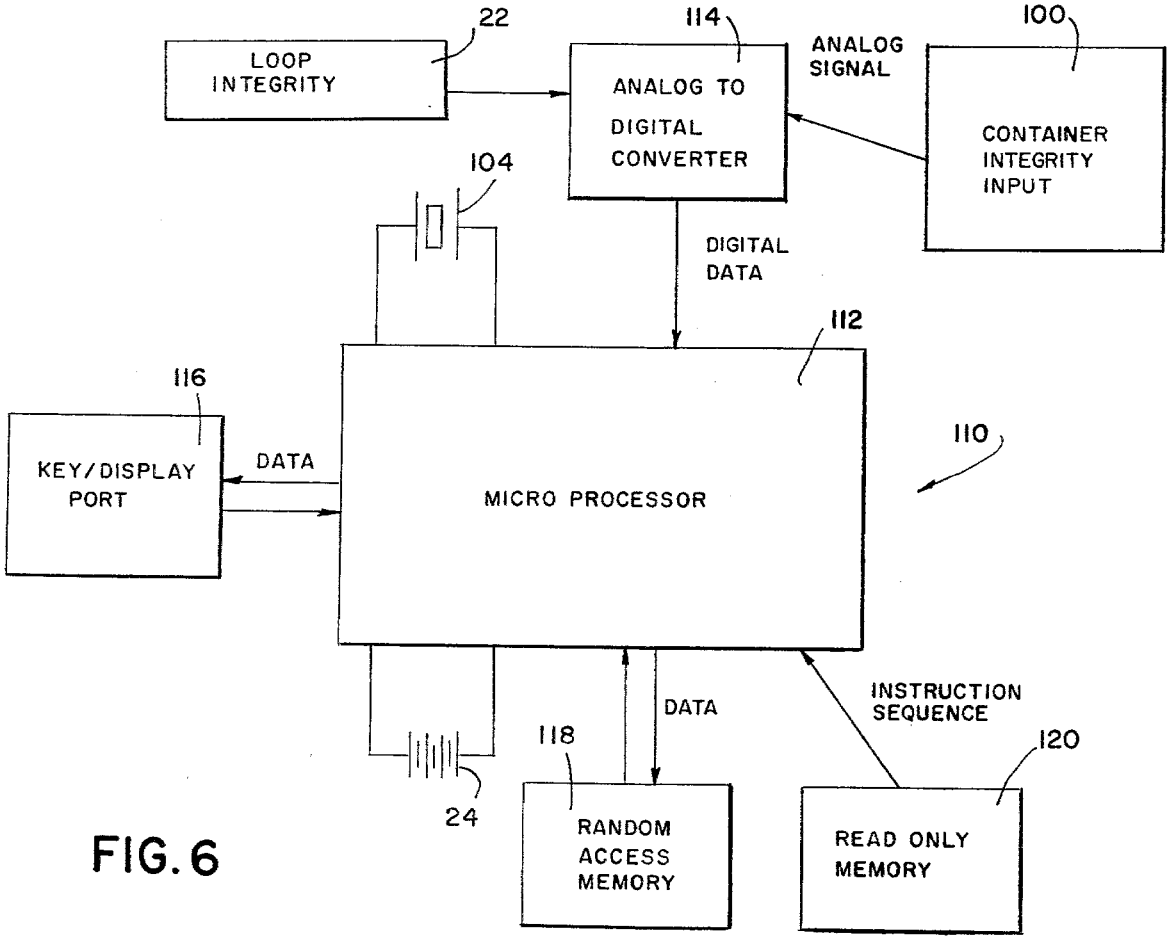
FIG. 6 is a schematic view of a preferred embodiment of the monitoring means for the self-monitoring seal of the present invention.

In a preferred form of the invention as shown in FIG. 6 a microelectronic system 110 is employed. Microprocessor 112 receives digital data from analog to digital converter 114 according to analog inputs from loop integrity sensor 22 and container integrity sensor 100. Microprocessor 112 controls the display 116 in predetermined sequence. As controlled by the random access memory 118 and the read only memory 120 and signal from crystal clock 104.

In operation the read only memory 120 supplies an instruction sequence to the microprocessor which stores data in random access memory 118. A signal from clock 104 causes the microprocessor to periodically change the display 116 in a predetermined manner according to memory instructions.

In one form of the invention, plural keys may be provided near the display 116 to input information to the microprocessor such as to provide the reading of the display on coded command or to permit the microprocessor to override or ignore signals from the analog to digital converter 114 indicating integrity violations so that the seal may be opened and resealed. Alternatively key 116 may be used to instruct the microprocessor initially or to change operations and data display sequences or may be used to start the microprocessor.

In one form of the invention, the memories and circuits may be constructed to self-destruct or to destroy data immediately upon container integrity violation or upon loop integrity violation. For example, a large capacitor may be connected to battery 24 and may be connected by a switch controlled by container integrity input 100 to supply a relatively large voltage pulse to the memories, and for that matter to the microprocessor and display.

In the examples shown in the drawings a readout is shown in the form of a display integral with the monitor. The readout may be transmitted to a remote terminal.

While the invention has been described with references to specific embodiments, it will be obvious to those skilled in the art that modifications and variations of the invention may be constructed without departing from the scope of the invention which is defined in the following claims.

What is claimed is:

1. Self-monitoring seal apparatus comprising container means, a continuous integral communication means extending from the container means for transmitting information from and to the container means, monitoring means mounted in the container means adjacent the communication means for communicating information into and out of the communication means and monitoring integrity of the seal, the communication means being passed through an article whose seal integrity is to be monitored.

2. The apparatus of claim 1 wherein the communication means comprises optical communication means.

3. The apparatus of claim 2 wherein the optical communication means comprises optical fibers having ends mounted in the container adjacent the monitoring means.

4. The apparatus of claim 3 wherein the optical fibers comprise a fiber-optic bundle.

5. Self-monitoring seal apparatus comprising container means, a continuous integral communication means extending from the container means for transmitting information from and to the container means, monitoring means mounted in the container means adjacent the communication means for communicating information into and out of the communication means and monitoring integrity of the seal, the communication means being passed through an article whose seal integrity is to be monitored, and a readout means connected to the container means and responsive to the monitoring means for indicating condition of the seal.

6. The apparatus of claim 5 wherein the readout means comprises an alphanumeric display having changeable characters.

7. The apparatus of claim 6 wherein the monitoring means comprises electronic means connected to the display for sequentially changing the display in a predetermined manner.

8. The apparatus of claim 6 wherein the monitoring means comprises integrity sensor means mounted in the container means adjacent the communication means to monitor the integrity of the communication means and pseudo-random generator means connected to the integrity sensor means and to the display and operative to sequentially change the display in a predetermined manner as long as the integrity sensor means does not indicate a violation of the integrity of the communication means and battery means connected to the pseudo-random generator means and to the integrity sensor means for providing power thereto.

9. The apparatus of claim 8 wherein the communication means comprises a light-transmitting loop having first and second ends connected to the container and wherein the integrity sensor means comprises a light source mounted in the container means adjacent the first end and light detector means mounted in the container means adjacent the second end and comparator means communicating with the light source and detector means for comparing the source and detector means.

10. The apparatus of claim 9 wherein the integrity sensor means further comprises a second light detector adjacent the light source and connected to the comparator whereby outputs of the light detectors are compared.

11. The apparatus of claim 8 wherein the psuedo-random generator comprises a shift register connected to the display and a clock means connected to the shift register for supplying clock pulses to the shift register, and wherein the apparatus further comprises a switch means connected to the integrity sensor means and connected to the shift register for providing integrity signals to the shift register and a keying means connected to the shift register for supplying keying signals to initially set the shift register whereby the shift register stores and shifts values according to clock pulse and signal inputs and sequentially changes the display in a predetermined manner when the communication means is intact and is connected to the container means.

12. The apparatus of claim 11 wherein the container means comprises a tamper resistant container means and further comprising a container integrity sensor connected to the switch means for changing status of the switch means upon container tampering.

13. Self-monitoring seal apparatus comprising container means, a continuous integral communication means extending from the container means for transmitting information from and to the container means, monitoring means mounted in the container means adjacent the communication means for communicating information into and out of the communication means and monitoring integrity of the seal, the communication means being passed through an article whose seal integrity is to be monitored, wherein the communicating means comprises a fiber optic bundle having first and second ends and further comprising clamping means for clamping the fiber optic bundle ends to the container means and wherein the monitoring means comprises a light source mounted in the container means adjacent one end of the fiber optic bundle and light detector means mounted in the container means adjacent the other end of the fiber optic bundle, comparator means for comparing output of the light source and the detector means and a comparing signal generator means connected to the comparator means for generating a signal when said comparator indicates a break in the communicating means and a changeable readout means connected to the comparing signal generator means for changing its readout in a predetermined manner in the absence of a signal from the comparing signal generator means.

14. The apparatus of claim 13 wherein the comparator means comprises second detecting means mounted adjacent the light source for detecting light from the light source and means for comparing the outputs of the two detector means.

15. The apparatus of claim 13 wherein the readout means comprises alphanumeric display apparatus.

16. The apparatus of claim 13 further comprising a power source connected to the container means for supplying power to the light source, detector means, comparing signal generator means, and readout means.

17. The apparatus of claim 13 further comprising a container integrity switching means connected to the comparing signal generating means for causing comparing the signal generator means to produce a signal upon operation of the container integrity means.

18. The apparatus of claim 13 wherein the container means comprises a stressed glass case.

19. The method of monitoring a seal comprising the steps of transmitting an optical signal through a continuous integral communication loop which engages an object to be sealed, receiving a signal from the communication loop, and electronically comparing the signals transmitted and received.

20. The method of claim 19 further comprising effecting generation of a comparing signal according responsive to the comparing step.

21. The method of claim 20 further comprising monitoring for tampering and changing the generation of a signal in response to the sensing of tampering.

22. The method of claim 20 further comprising displaying a readout responsive to the generation of the comparing signal.

23. The method of claim 20 wherein the generation comprises supplying a clocking signal to a microprocessor and creating a display signal in the microprocessor and supplying the display signal to a readout.

24. The method of claim 23 further comprising supplying container integrity signals and tampering signals to an analog to digital converter and supplying the resulting digital signals to the microprocessor.

25. Self-monitoring seal apparatus comprising container means, a continuous integral communication means extending from the container means for transmitting information from and to the container means, monitoring means mounted in the container means adjacent the communication means for communicating information into and out of the communication means and monitoring integrity of the seal, the communication means being passed through an article whose seal integrity is to be monitored, wherein the monitoring means comprises microprocessor means, readout means connected to the microprocessor means, and clock means connected to the microprocessor means, and further comprising communication means integrity sensor and container integrity sensor connected to the microprocessor means whereby the readout is changed by the microprocessor means in predetermined sequences while the communications means and the container means are integral.

* * * * *